US009982384B2

(12) United States Patent
Shin et al.

(10) Patent No.: US 9,982,384 B2
(45) Date of Patent: May 29, 2018

(54) DRAIN PUMP AND A CLOTHES DRYER HAVING A DRAIN PUMP

(71) Applicant: LG ELECTRONICS INC., Seoul (KR)

(72) Inventors: Jinhyouk Shin, Seoul (KR); Woocheol Kang, Seoul (KR); Minseong Kim, Seoul (KR); Sungjun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 393 days.

(21) Appl. No.: 14/793,991

(22) Filed: Jul. 8, 2015

(65) Prior Publication Data

US 2016/0010271 A1 Jan. 14, 2016

(30) Foreign Application Priority Data

Jul. 8, 2014 (KR) ..... 10-2014-0085437

(51) Int. Cl.
*D06F 58/20* (2006.01)
*F04D 29/42* (2006.01)
(Continued)

(52) U.S. Cl.
CPC ..... *D06F 58/20* (2013.01); *D06F 58/22* (2013.01); *D06F 71/40* (2013.01); *D06F 81/003* (2013.01);
(Continued)

(58) Field of Classification Search
CPC ..... D06F 58/20; D06F 58/22; D06F 71/40; D06F 81/003; F04D 29/4273;
(Continued)

(56) References Cited

U.S. PATENT DOCUMENTS 7,510,368 B2 * 3/2009 Stahle ..... F04D 1/04 415/121.1
8,438,750 B2 * 5/2013 Dittmer ..... D06F 58/22 134/10
2011/0277336 A1 11/2011 Shin et al.

FOREIGN PATENT DOCUMENTS

CN 1328218 12/2001
EP 2 386 679 11/2011
(Continued)

OTHER PUBLICATIONS

European Search Report dated Nov. 12, 2015.
(Continued)

*Primary Examiner* — Jessica Yuen
(74) *Attorney, Agent, or Firm* — Ked & Associates LLP

(57) ABSTRACT

A drain pump and a clothes dryer having a drain pump are provided. The drain pump may include a pump motor; an impeller including a hub, an impeller shaft that extends from a center of the hub and is connected to a rotational shaft of the pump motor, and at least one blade that extends from an outer circumferential surface of the impeller shaft; a housing including an impeller hole, through which the impeller may pass, and a space in which the pump motor may be accommodated; and a pump case coupled to a bottom surface of the housing. The pump case may have a suction hole to suction in cleaning water. The suction hole may be defined at a position corresponding to the impeller, and the pump case may include a shaft shield that extends from an edge of the suction hole in a central direction of the suction hole or toward a central portion of the suction hole to cover a lower end of the impeller shaft.

18 Claims, 11 Drawing Sheets

(51) Int. Cl.

| | |
|---|---|
| ***F04D 29/22*** | (2006.01) |
| ***F04D 1/00*** | (2006.01) |
| ***F04D 13/06*** | (2006.01) |
| ***D06F 58/22*** | (2006.01) |
| ***F04D 7/04*** | (2006.01) |
| ***F04D 29/70*** | (2006.01) |
| ***D06F 71/40*** | (2006.01) |
| ***D06F 81/00*** | (2006.01) |
| ***F04D 29/62*** | (2006.01) |

(52) U.S. Cl.
CPC ..... *F04D 1/00* (2013.01); *F04D 7/04* (2013.01); *F04D 13/06* (2013.01); *F04D 29/2216* (2013.01); *F04D 29/426* (2013.01); *F04D 29/4273* (2013.01); *F04D 29/628* (2013.01); *F04D 29/708* (2013.01)

(58) Field of Classification Search
CPC ..... F04D 29/708; F04D 1/14; F04D 13/06; F04D 29/426; F04D 29/4293; F04D 29/2216; F04D 7/04; F04D 1/00; F04D 29/628
See application file for complete search history.

(56) References Cited

FOREIGN PATENT DOCUMENTS

| | | | | |
|---|---|---|---|---|
| JP | 51-72169 | | 6/1976 | |
| JP | S51-72169 | | 6/1976 | |
| JP | 06-067887 | | 9/1994 | |
| JP | 10-43119 | | 2/1998 | |
| JP | 2001-355597 | | 12/2001 | |
| JP | 2009-50453 | | 3/2009 | |
| JP | 2013-202072 | | 10/2013 | |
| KR | 10-0332797 | | 4/2002 | |
| KR | 20-0352798 | | 6/2004 | |
| KR | 10-2013-0106506 | | 9/2013 | |
| KR | 10-1307078 | | 9/2013 | |
| WO | WO 2013117402 | A1 * | 8/2013 | ..... F04D 15/0088 |

OTHER PUBLICATIONS

International Search Report dated Oct. 15, 2015 issued in Application No. PCT/KR2015/006970.
Chinese Office Action dated Jan. 4, 2017 (English Translation).

* cited by examiner

DRAIN PUMP AND A CLOTHES DRYER HAVING A DRAIN PUMP

CROSS-REFERENCE TO RELATED APPLICATION(S)

The present application claims priority under 35 U.S.C. 119 and 35 U.S.C. 365 to Korean Patent Application No. 10-2014-0085437 filed in Korea on Jul. 8, 2014, which is hereby incorporated by reference in its entirety.

BACKGROUND

1. Field

A drain pump and a clothes dryer having a drain pump are disclosed herein.

2. Background

Clothes dryer are home appliances that supply hot wind into a drying drum to remove moisture absorbed into clothes in a state in which objects to be dried are put into the drying drum and rotated. Hot wind supplied into the drum may be generated by using electrical resistance heat or combustion heat using a gas fuel. Then, the hot wind may be supplied into the drying drum using a blower fan.

Clothes dryers may be classified into forced convection dryers and air vented dryers according to a hot air supply method. That is, forced convection dryers may be dryers in which hot air supplied into a drying drum is repeatedly heated and cooled while circulating inside of the dryer, and air vented dryers may be dryers in which hot air supplied into a drying drum is discharged from the drying drum to the outside.

During the drying of clothes, lint attached to clothes may be separated therefrom, and thus, float in air discharged from a drying drum, and foreign substances existing in the clothes may drop onto a bottom of the drying drum. To remove the lint contained in the air discharged from the drying drum, a lint filter assembly or lint filter may be mounted in a passage through which the air discharged from the drying drum flows.

When the lint accumulates on the lint filter assembly, the lint may interrupt a flow of air, increasing a load of the blower fan. As a result, drying performance may deteriorate, power consumption may increase, and the lint may act as a failure cause of the blower fan. Further, the lint accumulated during the drying process may be introduced into a fan motor or combustion device mounted on or at a lower portion of the drying drum through a gap between the drying drum and a cabinet, causing a fire in the dryer.

To solve this limitation, the foreign substances accumulated on the lint filter assembly have to be periodically removed. In a case of a detachable lint filter assembly, a user may periodically separate the lint filter assembly to clean the lint filter assembly and then re-mount the lint filter assembly.

Various methods for easily removing lint accumulated on the lint filter assembly are being attempted. Recently, a lint removing structure for removing lint using water in a state in which a lint filter assembly is mounted within the dryer has been proposed.

According to the related art, water is sprayed through nozzles disposed at front and rear sides of the lint filter assembly to remove lint accumulated on the lint filter assembly. The water sprayed from the nozzles and a lint lump separated from the lint filter assembly may be introduced into a drain pump and then discharged outside of the dryer.

However, in a case of the drain pump according to the related art, while the drain pump operates, foreign substances suctioned into the drain pump may block a suction hole of the drain pump or be wound around an impeller of the drain pump, causing a clogging phenomenon. The clogging phenomenon may increase a load of the drain pump, damaging the drain pump.

DETAILED DESCRIPTION

Figure 1:
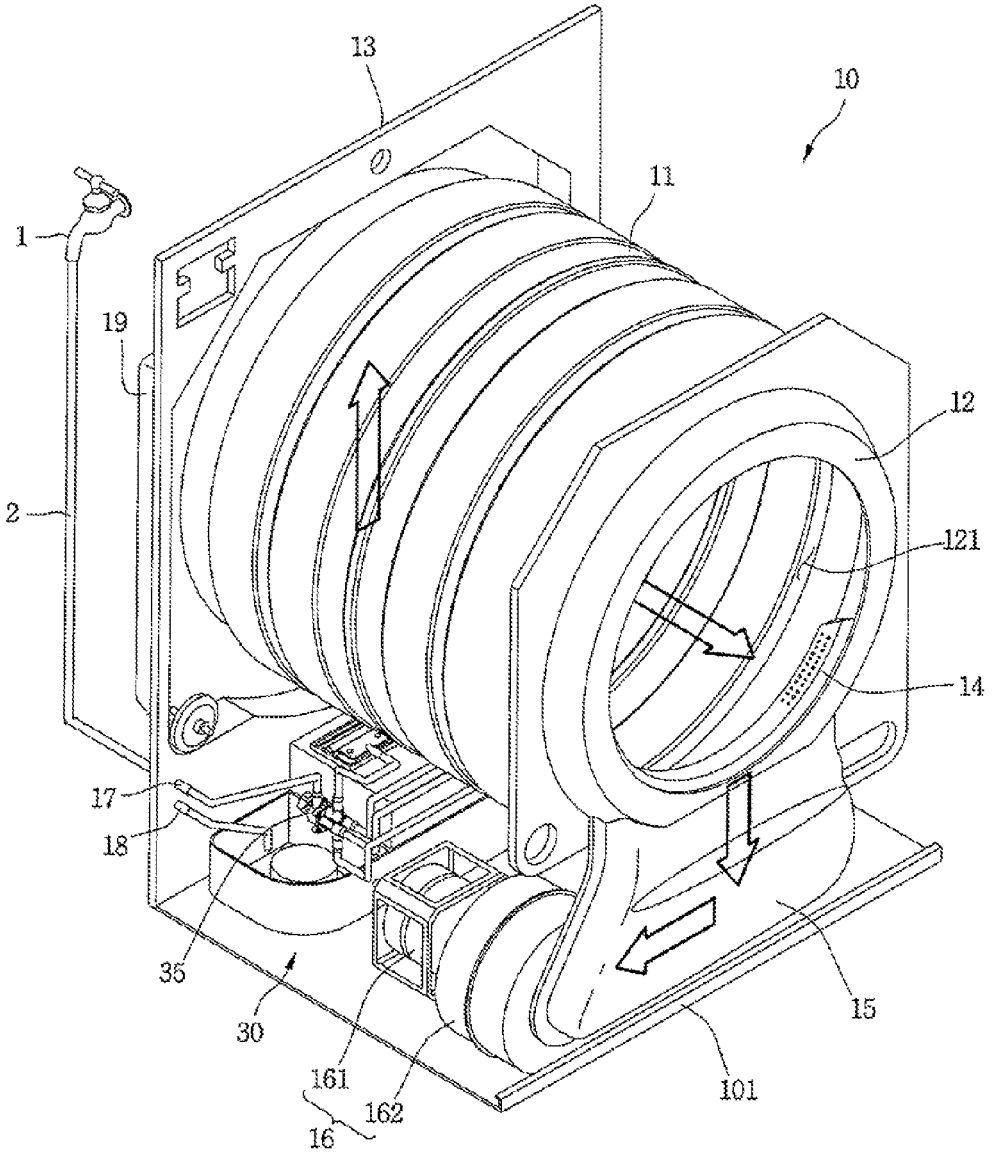
FIG. 1 is a perspective view of a clothes dryer including a lint filter cleaner according to an embodiment.

Hereinafter, a clothes dryer including a lint filter cleaning device or cleaner according to an embodiment will be described in detail with reference to the accompanying drawings. Wherever possible, like reference numerals have been used to indicate like elements, and repetitive disclosure has been omitted. Also, an air vented dryer will be described as an example of the clothes dryer including the lint filter cleaner according to an embodiment. However, the lint filter cleaner according to embodiments may be applied to various types of clothes dryers including a forced convection dryer as well as the air vented dryer.

Figure 2:
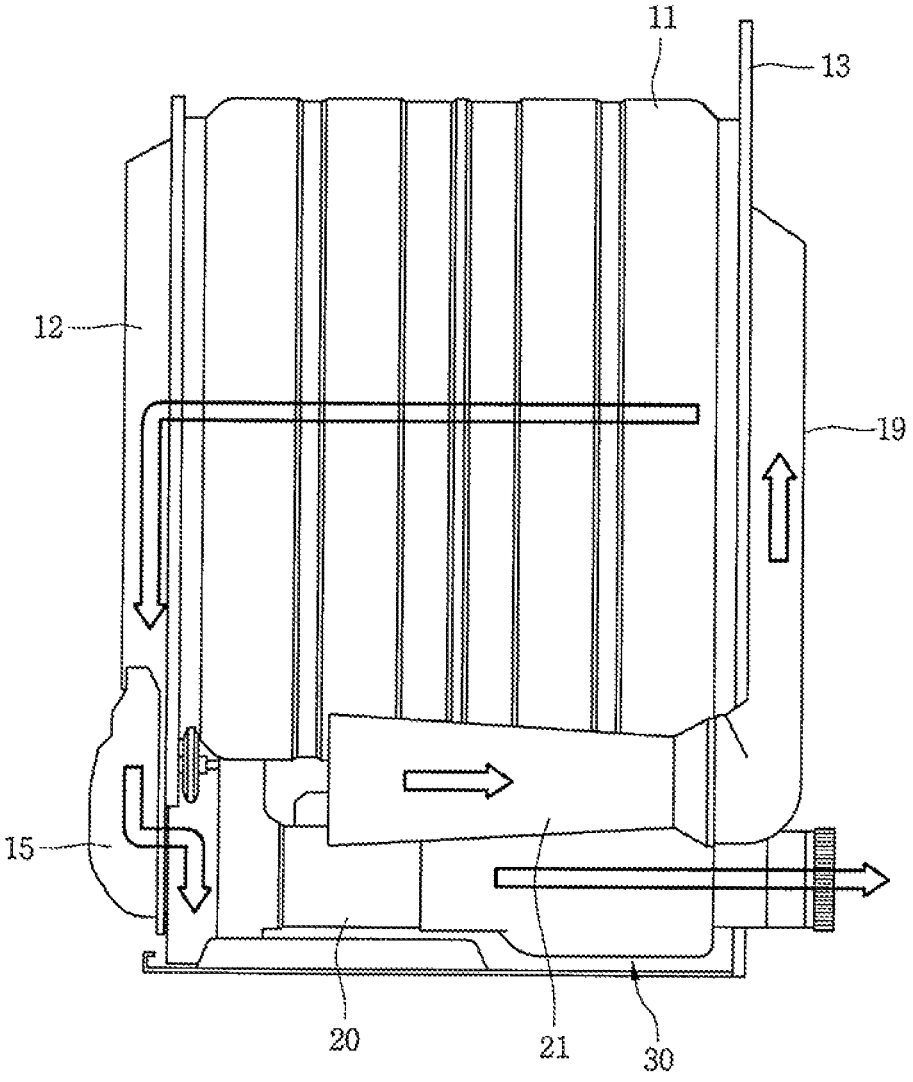
FIG. 2 is a side view of the clothes dryer of FIG. 1.

FIG. 1 is a perspective view of a clothes dryer including a lint filter cleaner according to an embodiment. FIG. 2 is a side view of the clothes dryer of FIG. 1.

Referring to FIGS. 1 and 2, a clothes dryer 10 including a lint filter cleaner according to an embodiment may include a drying drum 11, into which objects to be dried may be placed, a front cabinet 12 that supports a front portion of the drying drum 11, a blocking member 14 mounted on or at a bottom portion of the front cabinet 12, a rear cabinet 13 that supports a rear portion of the drying drum 11, and a lint filter cleaner 30 disposed under the drying drum 11. In detail, the clothes dryer 10 may further include a suction duct 21 to suction in air to be supplied into the drying drum 11, a rear duct 19 that connects the suction duct 21 to an air inflow hole defined in a rear surface of the drying drum 11, a guide duct 15 connected to a bottom surface of the front cabinet 12 to guide air discharged from the drying drum 11, a blower 16 connected to an outlet end of the guide duct 15, and an exhaust duct 20 connected to an outlet end of the blower 16. The lint filter cleaner 30 may be mounted on or at a predetermined position of the exhaust duct 20 to filter lint contained in air flowing along the exhaust duct 20 while the air passes through a lint filter assembly or lint filter 32 provided in the lint filter cleaner 30.

A middle cabinet (not shown) may be disposed between the front cabinet 12 and the rear cabinet 13 to protect the drying drum 11 and various components disposed under the drying drum 11. The middle cabinet may define both side surfaces and a top surface of the clothes dryer 10. A base plate 101 that defines a bottom portion of the clothes dryer 10 may be disposed on a bottom surface of the middle cabinet, and components may be mounted on the base plate 101.

The blocking member 14 may prevent foreign substances contained in the objects to be dried, for example, bulky and hard foreign matters, such as a coin, or a ballpoint pen, for example, from being suctioned into the guide duct 15 during the drying process. The foreign substances, such as lint, may be filtered by the lint filter 32, which will be described herein below, mounted on the lint filter cleaner 30, even though the foreign substances may be introduced into the guide duct 15. Other foreign substances, for example, bulky and soft foreign matters, may be blocked by the blocking member 14 to remain in the drying drum 11. If the foreign substances except for the lint are suctioned into the guide duct 15, the blower 16 may be damaged, or a rattling sound may be generated inside of the exhaust duct 20. Thus, it may be necessary to prevent the foreign substances from being drawn out of the drying drum 11 through the blocking member 14. Also, the blocking member 14 may be detachably coupled to the front cabinet 12.

The lint filter cleaner 30 may be connected to a cleaning water supply tube 17 and a cleaning water drain tube 18. The cleaning water supply tube 17 may have an inlet end mounted on the rear cabinet 13 and connected to a water supply tube 2 connected to an external water supply source 1. The cleaning water supply tube 17 may have an outlet end connected to an inflow port of a control valve 35 of the lint filter cleaner 30. The cleaning water drain tube 18 may have an inlet end connected to a drain pump (see reference numeral 40 of FIG. 3) of the lint filter cleaner 30.

The blower 16 may include a fan motor 161, and a blower fan 162 connected to a rotational shaft of the fan motor 161. The blower fan 162 may be disposed on or at the outlet end of the guide duct 15 to guide the air, which may pass through the drying drum 11 and be guided to the guide duct 15, to the exhaust duct 20.

In a case of the air vented dryer, a gas combustion device may be disposed on or at an inlet of the suction duct 21 to heat air suctioned into the suction duct 21 at or to a high temperature. In a case of an electric dryer, an electric heater may be mounted inside of the rear duct 19 to heat air introduced into the suction duct 21 at or to a high temperature before the air is introduced into the drying drum 11.

Briefly explaining a drying process of the clothes dryer 10 including the above-described components, objects to be dried may be put or placed into the drying drum 11 through an input hole 121 defined in the front cabinet 12. When a drying start command is input, the blower 16 may operate to introduce air into the suction duct 21 to be heated at or to a high temperature using the gas combustion device or the electric heater. Then, the air heated at or to the high temperature may be introduced into the drying drum 11 through a rear surface of the drying drum 11 along the rear duct 19. The high-temperature and dry air introduced into the drying drum 11 may change into high-temperature and high-humidity air while drying the objects to be dried. The high-temperature and high-humidity air may pass through the blocking member 14 in a state in which the air contains lint generated from the objects to be dried, and then, may be guided to the guide duct 15. The high-temperature and high-humidity air guided to the guide duct 15 may be guided to the exhaust duct 20 by the blower 16. The lint contained in the high-temperature and high-humidity air guided to the exhaust duct 20 may be filtered by the lint filter 32 while passing through the lint filter cleaner 30. The lint filter cleaner 30 may operate to separate the lint attached to the lint filter 32, and then, discharge the lint together with cleaning water using the drain pump 40.

The lint filter cleaner 30 may be provided in a circulation dryer using a heat pump. In detail, in the circulation dryer using the heat pump, a heat pump cycle may be mounted in a cabinet, and high-temperature and high-humidity air passing through the drying drum 11 may pass through an evaporator of the heat pump cycle. The air changing into low-temperature and dried air while passing through the evaporator may pass through a condenser of the heat pump cycle to change into high-temperature and dried air. The high-temperature and dried air passing through the condenser may be introduced into the drying drum 11 through a back surface of the drying drum 11 along the air duct. Also, the lint filter cleaner 30 may be mounted on or at a predetermined position of a humid air passage connected to the evaporator to filter foreign substances containing lint while the high-temperature and high-humidity air passes through the lint filter cleaner 30 before passing through the evaporator. The vapor contained in the humid vapor passing through the drying drum 11 may be condensed while passing through the evaporator. Condensed water may be guided into the drain pump 40 of the lint filter cleaner 30. That is, the water condensed while passing through the evaporator, as well as the water provided to clean the lint filter 32, may be guided into the drain pump 40.

Also, fine foreign substances may be contained in the air passing through the lint filter 32. The fine foreign substances may be attached to a surface of the evaporator. That is, fine lint may be attached to a tube and cooling fin of the evaporator. Thus, to remove the fine lint, a separate evaporator cleaning nozzle may be provided to remove the lint attached to the surface of the evaporator. Water used to clean the evaporator may be guided into the drain pump 40 of the lint filter cleaner 30.

Hereinafter, a structure and operation of the lint filter cleaner 30 will be described with reference to the accompanying drawings.

Figure 3:
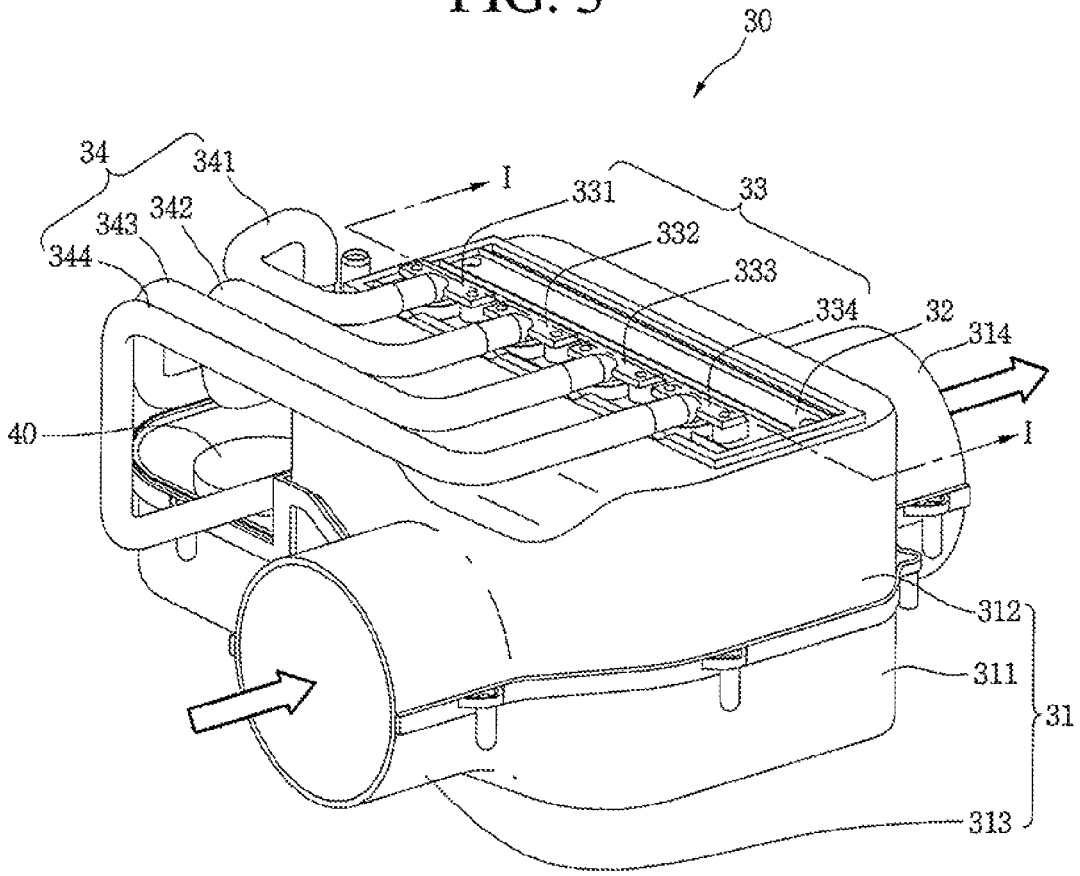
FIG. 3 is a perspective view of the lint filter cleaner according to an embodiment.
Figure 4:
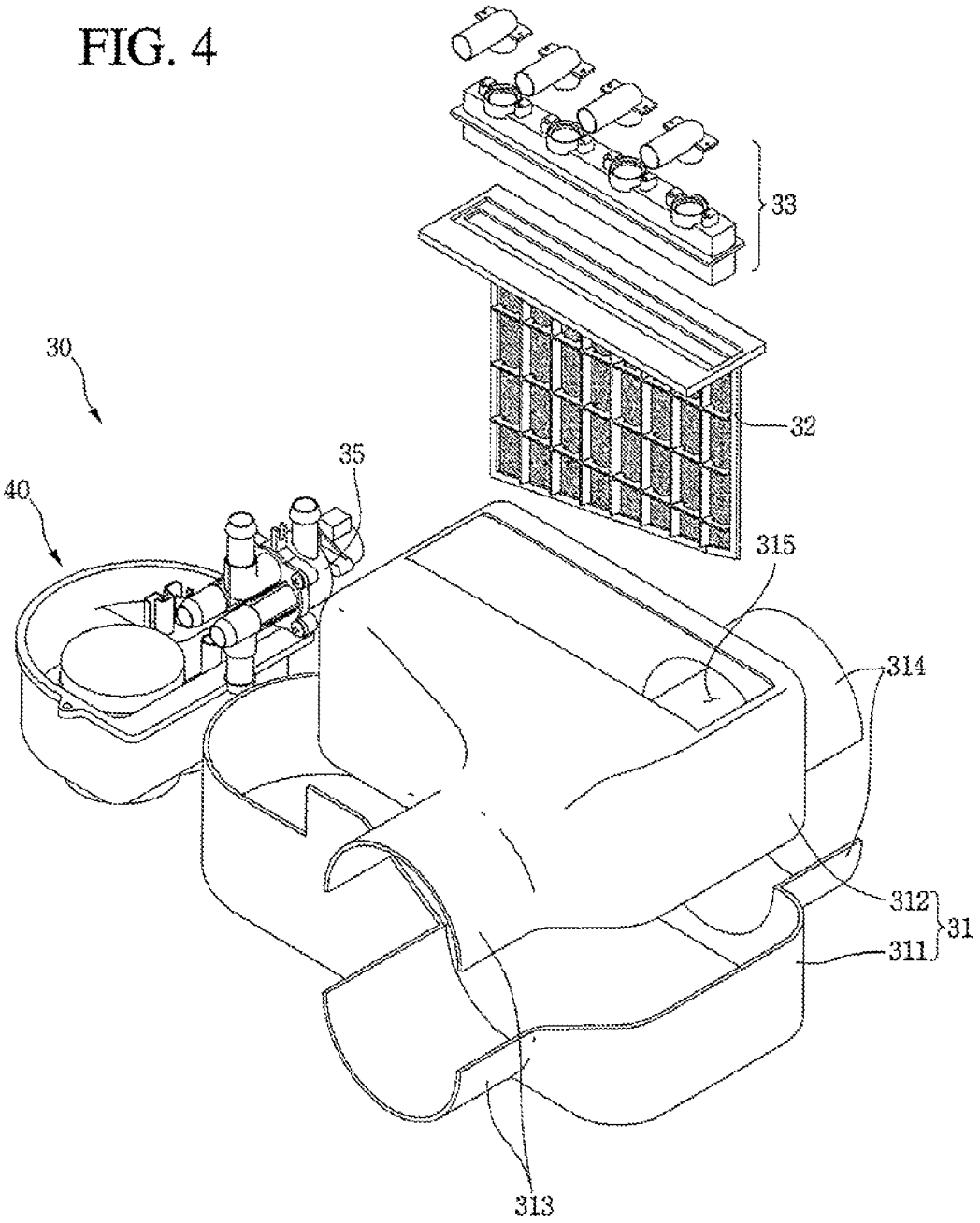
FIG. 4 is an exploded perspective view of the lint filter cleaner of FIG. 2.
Figure 5:
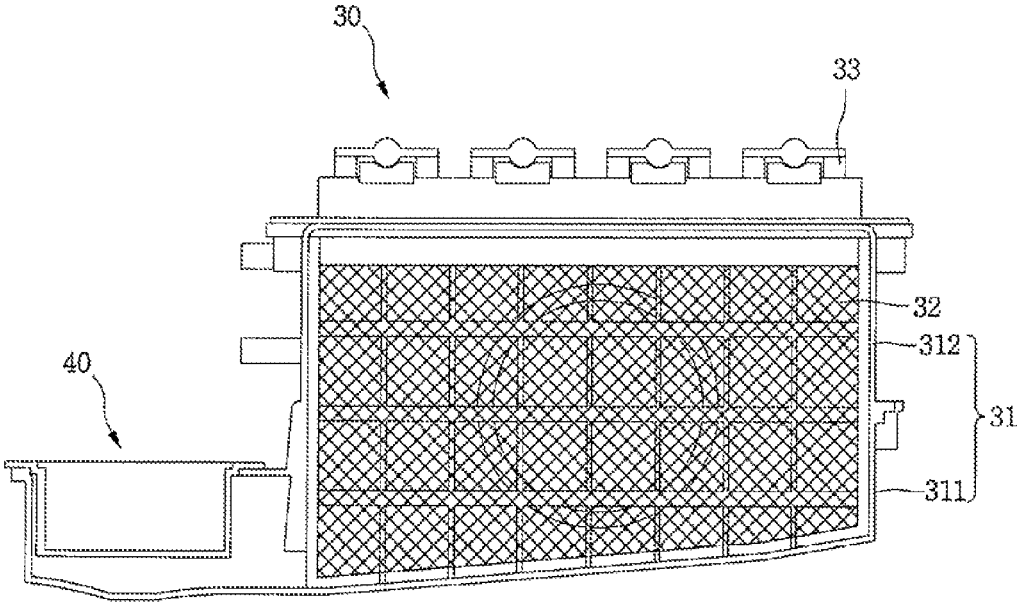
FIG. 5 is a cross-sectional view taken along line V-V of FIG. 3.

FIG. 3 is a perspective view of the lint filter cleaner according to an embodiment. FIG. 4 is an exploded perspective view of the lint filter cleaner according to an embodiment. FIG. 5 is a cross-sectional view taken along line I-I of FIG. 3.

Referring to FIGS. 3 to 5, the lint filter cleaner 30 according to an embodiment may include a cleaning case 31 including a lower case 311 and an upper case 312, the lint filter 32 disposed inside of the cleaning case 31, a water supply port array 33 disposed on a top surface of the lint filter 32, a water supply tube array 34 connected to an outlet end of the water supply port array 33, the control valve 35 connected to an inlet end of the water supply tube array 34, and the drain pump 40 accommodated at one inner side of the pump housing 31. The water supply port array 33, the water supply tube array 34, and the control valve 35 may be defined as a cleaning water supply unit or supplier. The lint filter 32 may vertically stand up inside of the cleaning case 31. An insertion hole 315, through which the lint filter 32 may pass, may be defined in the upper case 312.

An inflow hole 313, through which the high-temperature and high-humidity air passing through the drying drum 11 may be introduced, may be defined in one side of the cleaning case 31, and a discharge hole 314, through which the high-temperature and high-humidity air passing through the lint filter 32 may be discharged, may be defined in a surface opposite to the surface in which the inflow hole 313 is defined. Also, cleaning water dropping onto a bottom of the cleaning case 31 may flow toward the bottom of the cleaning case 31 on which the drain pump 40 is disposed.

The water supply port array 33 may include a plurality of supply ports disposed to be spaced a predetermined distance from each other at a top surface of the lint filter 32. Although the water supply tube array 33 includes first to fourth supply ports 331, 332, 333, and 334 in this embodiment, embodiments are not limited thereto. For example, a number of the supply ports may be adequately set according to a size of the lint filter 32.

Also, the water supply tube array 34 may include a plurality of supply tubes connected to the water supply port array 33. Although the water supply tube array 34 includes first to fourth water supply tubes 341, 342, 343, and 344 in this embodiment, embodiments are not limited thereto. For example, a number of the water supply tubes may be adequately set according to the number of supply ports.

Figure 6:
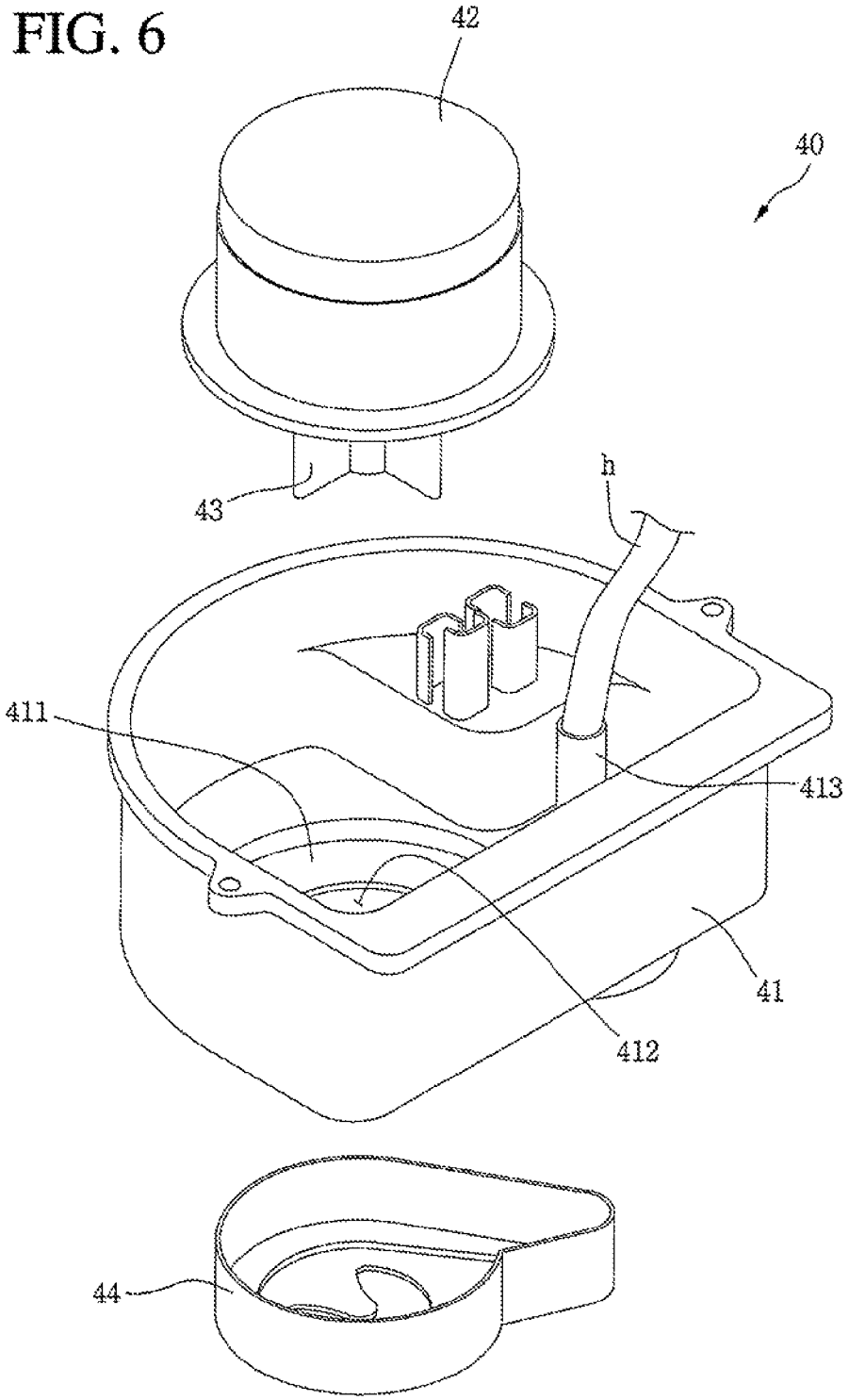
FIGS. 6 and 7 are exploded perspective views of a drain pump for a clothes dryer according to an embodiment.
Figure 7:
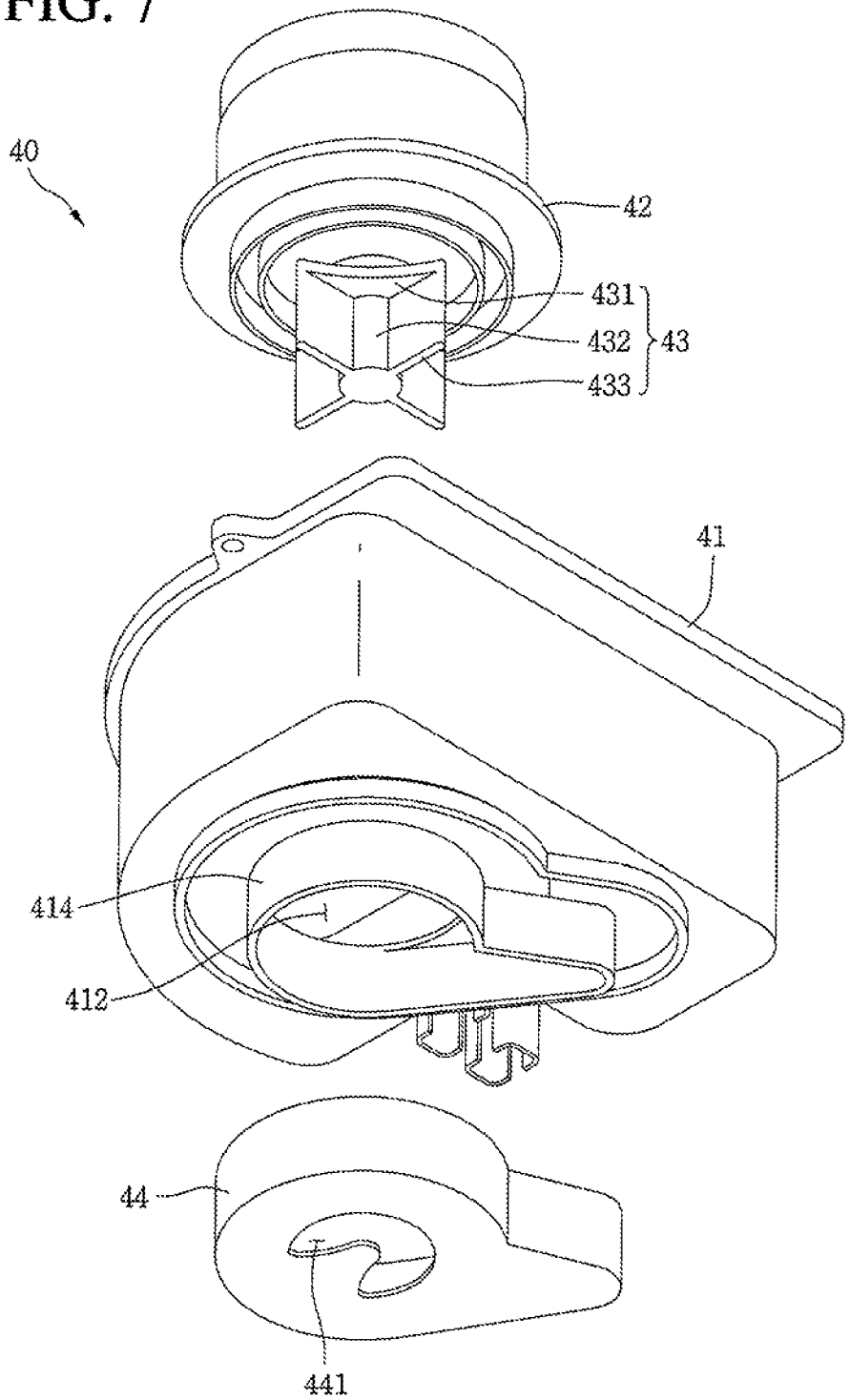
Figure 8:
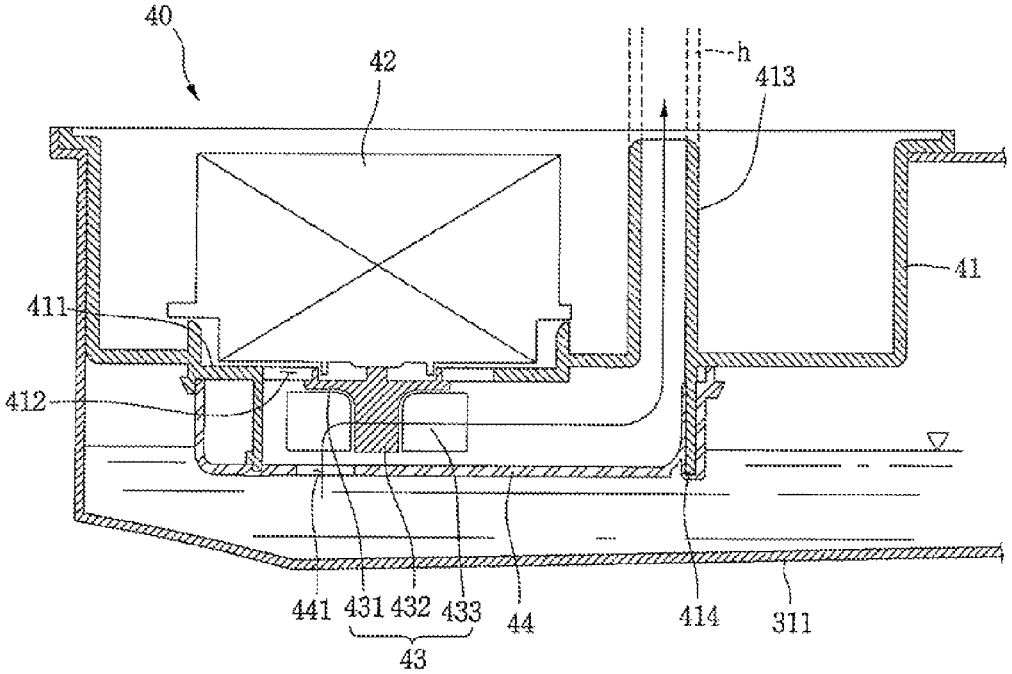
FIG. 8 is a cross-sectional view of the drain pump for a clothes dryer according to an embodiment.

FIGS. 6 and 7 are exploded perspective views of a drain pump for a clothes dryer according to an embodiment. FIG. 8 is a cross-sectional view of the drain pump for a clothes dryer according to an embodiment.

Referring to FIGS. 6 to 8, the drain pump 40 according to an embodiment may include a housing 41, a pump motor 42, an impeller 43, and a pump case 44. In detail, the housing 41 may be mounted on or at one side of the lower case 311. The housing 41 may have a bottom and a side that extends upward from an edge of a bottom surface to define a space to accommodate the pump motor 42. A space to accommodate the housing 41 may be defined in or at one side of the lower case 311. A bottom surface of the lower case 311, in which the housing 41 may be accommodated, may be recessed so that the cleaning water may be collected. Also, a bottom part or portion of the lower case 311, in which the housing 41 may be accommodated, may be inclined downward toward the drain pump 40. Thus, the cleaning water flowing along the lint filter 32 may flow toward the bottom portion of the lower case 311, in which the housing 41 may be accommodated.

A pump motor seat 411, on which the pump motor 42 may be seated, may be disposed on a bottom part or portion of the housing 41. The pump motor seat 411 may be stepped downward at a predetermined depth. An impeller hole 412, through which the impeller 43 may pass, may be defined with a predetermined size inside of the pump motor seat 411. In detail, the impeller hole 412 may have a diameter less than a diameter of the pump motor seat 411. Thus, the pump motor 42 may be seated on the motor seat 411.

A discharge port 413 may protrude by a predetermined length from any point of the bottom portion of the housing 41, which may be spaced apart from the pump motor seat 411, and a drain hose h may be connected to the discharge port 413. The discharge port 413 may communicate with the pump case 44 coupled to a bottom surface of the housing 41. Thus, the cleaning water pumped in the pump case 44 may be discharged into the drain hose h through the discharge port 413.

A flow guide rib 414 may extend downward from a bottom surface of the housing 41, and the impeller 43 may be accommodated into a space defined by the flow guide rib 414. When the pump case 44 is coupled to the bottom surface of the housing 41, a lower end of the flow guide rib 414 may be closely attached to a bottom of the pump case 44.

The pump case 44 may have a size sufficient to accommodate the flow guide rib 414. In detail, the pump case 44 may have a size greater than a size of the flow guide rib 414 and have substantially a same shape as the flow guide rib 414. Also, the pump case 44 may have a depth (or thickness) equal to an extension length of the flow guide rib 414.

A suction hole 441 may be defined in the bottom of the pump case 44. The cleaning water may be suctioned through the suction hole 441 and rotated by the impeller 43, and then, may be pumped into the discharge port 413.

The impeller 43 may include a hub 431, an impeller shaft 432 that extends by a predetermined length from a center of the hub 431 and connected to the rotational shaft of the pump motor 42, and a plurality of blades 433 that extends from an outer circumferential surface in a radial direction.

In detail, a portion at which a bottom surface of the hub 431 and the impeller shaft 432 meet each other may be rounded with a predetermined curvature. As described above, as an edge of the impeller shaft 432 may be smoothly rounded, the cleaning water suctioned upward through the suction hole 441 may collide with the hub 431 to smoothly change in the radial direction of the impeller 43, thereby minimizing flow resistance.

Also, as illustrated in the drawings, four blades 433 may be spaced a predetermined distance from each other in a circumferential direction; however, embodiments are not limited thereto. For example, at least two blades 433 may be spaced a predetermined distance from each other in the circumferential direction according to a design thereof. Each of the blades 433 may have a height that extends by a length corresponding to a height of the impeller shaft 432. Each blade 433 may extend up to an edge of the hub 431. Also, as illustrated in the drawings, the hub 431 may have a rectangular shape or a circular shape.

Figure 9:
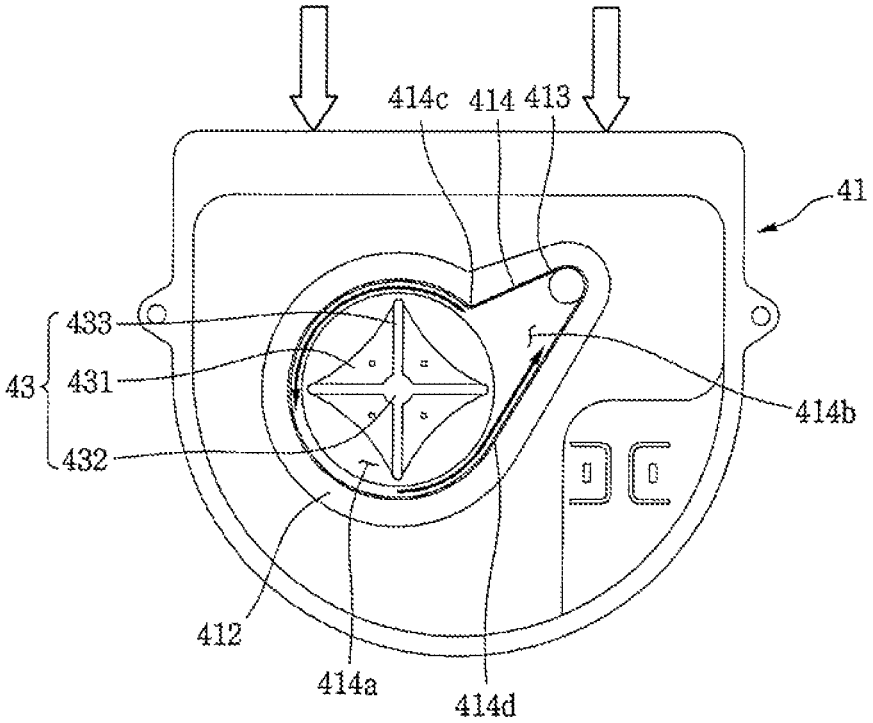
FIG. 9 is a view of a bottom surface of the drain pump according to an embodiment, from which a pump case is removed.

FIG. 9 is a view of a bottom surface of the drain pump according to an embodiment, from which a pump case is removed. Referring to FIG. 9, the flow guide rib 414 may extend from the bottom surface of the pump case 41. The flow guide rib 414 may extend along an edge of the impeller hole 412.

In detail, an inner region of the flow guide rib 414 may be defined into or as a rotation region 414*a* including the impeller hole 412, and a discharge region 414*b* that extends outward from the rotation region 414*a*. The discharge region 414*b* may extend in a shape a width of which gradually decreases in a direction that extends away from the rotation region 414*a*. The discharge port 413 may be disposed on or at an end of the discharge region 414*b*.

The rotation region 414*a* may be a region in which the cleaning water suctioned through the suction hole 441 of the pump case 44 is rotated in a rotation direction of the impeller 43 by the impeller 43. The discharge region 414*b* may be a region in which the cleaning water rotated in the rotation region 414*a* is discharged into the discharge port 413 by centrifugal force.

A point at which the flow guide rib 414 that defines the discharge region 414*b* and the flow guide rib 414 that defines the rotation region 414*a* meet each other may be defined as a rotation start point 414*c* and a discharge start point 414*d*. The rotation start point 414*c* may be defined in or at a side in or at which the cleaning water containing lint flows from the lint filter 32 toward the pump case 41. For reference, an arrow expressed above the pump case 41 may represent a flow direction of the cleaning water flowing from the lint filter 32, and an arrow expressed inside of the flow guide rib 414 may represent a flow direction of the cleaning water suctioned by the impeller 43.

Further, the discharge start point 414*d* may be defined at a side opposite to the rotation start point 414*c*. Furthermore, a portion of the flow guide rib 414 that extends from the discharge start point 414*d* to the discharge port 413 may extend along a tangent of a circle that defines the rotation region 414*a*.

As described above, when the cleaning water suctioned by the impeller 43 is rotated by the impeller 43, and then, is discharged toward the discharge port 413, the cleaning water may be smoothly discharged in the tangential direction of the rotation region 414*a*. Thus, a phenomenon in which foreign substances are hung up at a boundary between the rotation region 414*a* and the discharge region 414*b* may be prevented.

Figure 10:
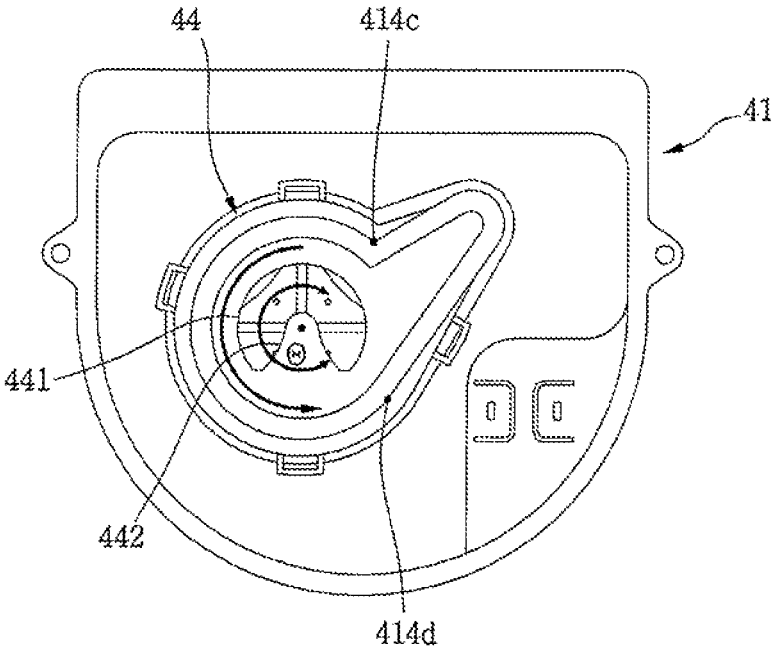
FIG. 10 is a view of a bottom surface of the drain pump according to an embodiment, on which the pump case is mounted.

FIG. 10 is a view of a bottom surface of the drain pump according to an embodiment, on which a pump case is mounted. Referring to FIG. 10, the pump case 44 may be mounted on the bottom surface of the housing 41 to cover the flow guide rib 414.

In detail, the pump case 44 may have substantially a same shape as that of a passage defined by the flow guide rib 414. Also, the pump case 44 may have a size greater than a size of the passage defined by the flow guide rib 414. Thus, the pump case 44 may be divided into a rotation region and a discharge region. The suction hole 441 may be defined in the rotation region.

In detail, although the suction hole 441 has a circular shape, embodiments are not limited thereto. For example, the suction hole 441 may have a same center as the impeller shaft 432. Also, a shaft shield 442 may extend from an edge of the suction hole 41 in a central direction of the suction hole 441 or toward or to a central portion of the suction hole 441. The shaft shield 442 may have a size that is enough or sufficient to extend in the central direction of the suction hole 441 and cover an end of the impeller shaft 432.

As the shaft shield 442 may cover the end of the impeller shaft 432, a phenomenon in which foreign substances, such as hair, contained in the cleaning water introduced into the suction hole 441 are wound around the impeller shaft 432 may be prevented. Further, the suction hole 441 may have a shape that is symmetric with respect to a bisector that passes through a center of the impeller shaft 432 and bisectionally divides the shaft shield 442.

Also, the discharge start point 414*d* may be defined at a point that is spaced a predetermined angle θ from the rotation start point 414*c* in the rotation direction of the impeller 43. The predetermined angle θ may be about 270 degrees. The cleaning water passing though the discharge start point 414*d* while rotated by the impeller 43 may move into the discharge region by the centrifugal force and then may be discharged into the discharge port 414.

Figure 11:
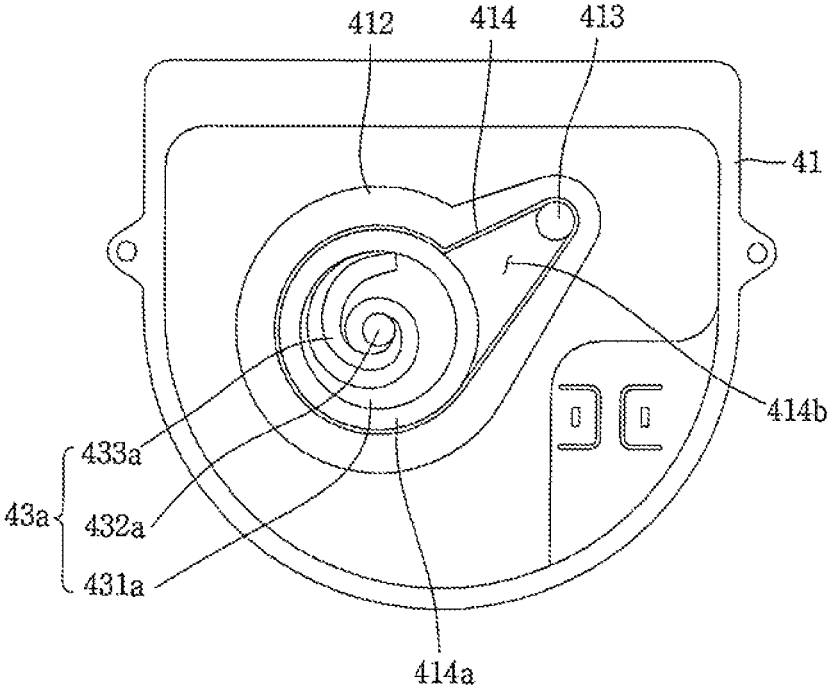
FIG. 11 is a view illustrating a structure of an impeller according to another embodiment.

FIG. 11 is a view illustrating a structure of an impeller according to this embodiment. Referring to FIG. 11, an impeller 43*a* according to this embodiment may be the same as the previous embodiment in that the impeller 43*a* includes a hub 431*a*, an impeller shaft 432*a*, and a blade 433*a*. That is, the impeller 43*a* according to this embodiment may be the same as the previous embodiment except for a shape of the blade 433*a*.

In detail, as illustrated in FIG. 11, the blade 433*a* may have a single blade shape that is spirally wound from the impeller shaft 432*a*. Also, a winding direction of the blade 433*a* may be opposite to a rotational direction of the impeller 43*a*. As the blade 433*a* of the impeller 43*a* is wound in a direction opposite to the rotational direction of the impeller 43*a*, the phenomenon in which the foreign substances, such as hair, contained in the cleaning water suctioned through the suction hole 441 are wound around the impeller shaft 432*a* may be prevented.

According to the drain pump assembly and the clothes dryer having a drain pipe according to embodiments, a phenomenon in which foreign substances contained in cleaning water used to clean the lint filter are hung up within the drain pump or block an inside of the drain pump may be minimized. In detail, the phenomenon in which the foreign substances, such as hair, are hung up on an inlet-side of the drain pump, or hair is wound around a shaft of the impeller of the drain pump to close an inlet end of the drain pump may be minimized. Therefore, power consumption and damage to the drain pump may be minimized.

Embodiments disclosed herein provide a drain pump assembly or drain pump that may include a pump motor; an impeller including a hub, an impeller shaft that extends from a center of the hub and is connected to a rotational shaft of the pump motor, and a blade that extends from an outer circumferential surface of the impeller shaft; a housing including an impeller hole through which the impeller may pass, and a space in which the pump motor may be accommodated; and a pump case coupled to a bottom surface of the housing. The pump case may have a suction hole to suction in cleaning water. The suction hole may be defined in or at a position corresponding to the impeller. The pump case may include a shaft shield part or shaft shield that extends from an edge of the suction hole in a central direction of the suction hole to cover a lower end of the impeller shaft.

Embodiments disclosed herein provide a dryer for clothes that may include a cabinet; a drying drum accommodated in the cabinet and into which an object to be dried may be put or placed; a suction passage that supplies hot wind into the drying drum; a heating unit or heater disposed at a predetermined position in the suction passage to heat air introduced into the suction passage at or to a high temperature; an exhaust passage, through which the hot wind discharged from the drying drum may flow; a blower mounted at one or a first position in the exhaust passage to forcibly blow the air within the drying drum; a lint filter assembly mounted at another or a second position in the exhaust passage; and a lint filter cleaning device or cleaner that removes lint attached to the lint filter assembly. The lint filter cleaning device may include a cleaning case that accommodates the lint filter assembly; a cleaning water supply unit or supplier disposed outside of the cleaning case to spray the cleaning water onto the lint filter assembly; and a drain pump assembly or drain pump disposed on or at one side of the cleaning case to drain the cleaning water flowing along the lint filter assembly together with foreign substances attached to the lint filter assembly.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drain pump, comprising:

a pump motor;

an impeller including:

a hub;

an impeller shaft that extends from a center of the hub and is connected to a rotational shaft of the pump motor; and at least one blade that extends from an outer circumferential surface of the impeller shaft;

a housing including:

an impeller hole, through which the impeller passes; and a space in which the pump motor is accommodated; and a pump case coupled to a bottom surface of the housing, wherein the pump case includes:

a suction hole to suction in cleaning water, wherein the suction hole is defined at a position corresponding to the impeller; and a shaft shield that extends from an edge of the suction hole toward a central portion of the suction hole to cover the impeller shaft, wherein a width of the shaft shield becomes narrower as the shaft shield extends closer to the central portion of the suction hole.

2. The drain pump according to claim 1, further comprising:

a pump motor seat stepped from a bottom of the housing, such that the pump motor is seated thereon; and a discharge port that extends from a predetermined position which is spaced apart from the pump motor seat.

3. The drain pump according to claim 2, further comprising a flow guide rib that extends from the bottom surface of the housing to guide the cleaning water suctioned through the suction hole to the discharge port, wherein the flow guide rib has a close-loop shape that surrounds the suction hole and the discharge port.

4. The drain pump according to claim 3, wherein, when the pump case is coupled to the bottom surface of the housing, the flow guide rib is closely attached to a bottom of the pump case.

5. The drain pump according to claim 3, wherein the impeller is accommodated in a space defined by the flow guide rib and the pump case.

6. The drain pump according to claim 5, wherein a point at which a first end of first and second ends of the flow guide rib that defines the discharge region meets a portion of the flow guide rib that defines the rotation region is defined as a rotation start point, wherein a point at which the second end of the first and second ends of the flow guide rib that defines the discharge region meets a portion of the flow guide rib that defines the rotation region is defined as a discharge start point, and wherein a portion of the flow guide rib, which extends from the discharge start point to define the discharge region, extends along a tangent line that passes through the discharge start point.

7. The drain pump according to claim 3, wherein the pump case has substantially a same shape as the flow guide rib, and wherein a size of the pump case is greater than a size of the flow guide rib, such that when the pump case is coupled to the bottom surface of the housing, the flow guide rib is covered by the pump case.

8. The drain pump according to claim 2, wherein the impeller hole is defined inside of the pump motor seat.

9. The drain pump according to claim 8, wherein a space defined by a coupling of a flow guide rib and the pump case includes:

a rotation region defined by a portion of the flow guide rib that extends along an edge of the impeller hole; and a discharge region that communicates with the rotation region, wherein the discharge region is defined by a portion of the flow guide rib that extends from the rotation region to the discharge port, and wherein the cleaning water suctioned in through the suction hole is rotated in the rotation region by a centrifugal force to move into the discharge region and is guided to the discharge port.

10. The drain pump according to claim 9, wherein a point at which a first end of first and second ends of the flow guide rib that defines the discharge region meets a portion of the flow guide rib that defines the rotation region is defined as a rotation start point, wherein a point at which the second end of the first and second ends of the flow guide rib that defines the discharge region meets a portion of the flow guide rib that defines the rotation region is defined as a discharge start point, and wherein a portion of the flow guide rib, which extends from the discharge start point to define the discharge region, extends along a tangent line that passes through the discharge start point.

11. The drain pump according to claim 9, wherein the impeller is accommodated in the rotation region.

12. The drain pump according to claim 1, wherein the at least one blade includes a plurality of blades that extends from the impeller shaft to an edge of the hub, and wherein the plurality of blades is disposed to be spaced a predetermined angle from each other in a circumferential direction.

13. The drain pump according to claim 1, wherein the at least one blade comprises a single blade spirally wound from the impeller shaft in a direction of an edge of the hub, and wherein a winding direction of the blade is opposite to a rotational direction of the impeller.

14. The drain pump according to claim 1, wherein the suction hole is defined in a bottom portion of the pump case.

15. A clothes dryer comprising the drain pump according to claim 1.

16. A clothes dryer, comprising:

a cabinet;

a drying drum accommodated in the cabinet and into which an object to be dried is placed;

a suction passage that supplies hot wind into the drying drum;

a heater disposed at a predetermined position in the suction passage to heat air introduced into the suction passage to a high temperature;

an exhaust passage, through which the hot wind discharged from the drying drum flows;

a blower mounted in the exhaust passage to forcibly blow the air within the drying drum;

a lint filter mounted in the exhaust passage; and a lint filter cleaner that removes lint attached to the lint filter, wherein the lint filter cleaner includes:

a cleaning case that accommodates the lint filter;

a cleaning water supplier disposed outside of the cleaning case to spray the cleaning water onto the lint filter; and the drain pump according to claim 1, wherein the drain pump is disposed at one side of the cleaning case to drain the cleaning water flowing along the lint filter together with foreign substances attached to the lint filter.

17. A drain pump, comprising:

a pump motor;

an impeller including:

a hub;

an impeller shaft that extends from a center of the hub and is connected to a rotational shaft of the pump motor; and at least one blade that extends from an outer circumferential surface of the impeller shaft;

a housing including:

a bottom wall having:

a pump motor seat stepped downward to allow the pump motor to be seated; and an impeller hole, through which the impeller passes, defined inside the pump motor seat;

a side wall that upwardly extends from an edge of the bottom wall to accommodate the pump motor; and a discharge port that upwardly extends from the bottom wall at a position which is spaced apart from the pump motor seat; and a pump case coupled to a bottom surface of the housing, the pump case including:

a suction hole to suction in cleaning water, wherein the suction hole is defined at a position corresponding to the impeller; and a shaft shield that extends from an edge of the suction hole toward a central portion of the suction hole to cover the impeller shaft, wherein a space defined by a coupling of a flow guide;

a rotation region defined by a portion of the flow guide rib that extends along an edge of the impeller hole; and a discharge region that communicates with the rotation region, wherein the discharge region is defined by a portion of the flow guide rib that extends from the rotation region to the discharge port, and wherein the cleaning water suctioned in through the suction hole is rotated in the rotation region by a centrifugal force to move into the discharge region and is guided to the discharge port.

18. A clothes dryer comprising the drain pump according to claim 5.

* * * * *